US007134491B2

(12) United States Patent
Kohli et al.

(10) Patent No.: US 7,134,491 B2
(45) Date of Patent: Nov. 14, 2006

(54) LEAK REMEDY THROUGH SEALANTS IN LOCAL RESERVOIRS

(75) Inventors: Harjit Kohli, Sugar Land, TX (US); Hebah Ahmed, Houston, TX (US); Michael Johnson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 234 days.

(21) Appl. No.: 10/304,437

(22) Filed: Nov. 26, 2002

(65) Prior Publication Data

US 2003/0098064 A1 May 29, 2003

Related U.S. Application Data

(60) Provisional application No. 60/333,560, filed on Nov. 27, 2001, provisional application No. 60/333,543, filed on Nov. 27, 2001.

(51) Int. Cl.
*E21B 47/10* (2006.01)
*F17J 15/06* (2006.01)

(52) U.S. Cl. ..... 166/250.08; 166/277; 277/531; 277/512; 277/342

(58) Field of Classification Search ..... 166/277, 166/250.08, 90.1, 153, 187; 29/402.18, 530; 277/531, 529, 512, 513, 339, 342
See application file for complete search history.

(56) References Cited

U.S. PATENT DOCUMENTS

| | | | | |
|---|---|---|---|---|
| 2,804,147 | A * | 8/1957 | Pistole et al. | 166/277 |
| 2,954,827 | A | 10/1960 | Wheeler | |
| 3,199,598 | A * | 8/1965 | Loomis | 166/147 |
| 3,614,988 | A | 10/1971 | Moore | |
| 4,714,377 | A * | 12/1987 | Sandt et al. | 405/184.5 |
| 4,882,830 | A * | 11/1989 | Carstensen | 29/421.1 |
| 6,446,717 | B1 * | 9/2002 | White et al. | 166/187 |

* cited by examiner

*Primary Examiner*—Kenneth Thompson
(74) *Attorney, Agent, or Firm*—Van Someren, P.C.; Kevin P. McEnaney; Jaime A. Castano

(57) ABSTRACT

The present invention provides a method for remedying minute seal leaks in downhole tools and equipment. The various embodiments of the present invention utilize pressure activated liquid sealants stored in local reservoirs to remedy such leaks.

25 Claims, 6 Drawing Sheets

LEAK REMEDY THROUGH SEALANTS IN LOCAL RESERVOIRS

This application claims the benefit of U.S. Provisional Application No. 60/333,560, filed Nov. 27, 2001, and U.S. Provisional Application No. 60/333,543, filed Nov. 27, 2001.

FIELD OF THE INVENTION

The subject matter of the present invention relates to providing a leak remedy for downhole tools and equipment. More specifically, the present invention provides a method for remedying downhole equipment leaks through the use of a local reservoir of liquid sealants.

BACKGROUND OF THE INVENTION

When drilling, running completions, performing workovers, or performing any number of oilfield operations, a final assembly of the tools or equipment is typically performed at the location of the well. To validate the proper assembly of the tools or equipment, pressure tests are often performed. The pressure tests verify that the various seals are functional after assembly.

Due to the pressure range necessary and the subsequent resolution of the pressure measuring equipment, minute leaks such as those sometimes seen in metal-metal seals, may remain undetected after the pressure tests. Additionally, minute leaks may develop over the course of the lifetime of the seals. Undetected or later developed minute leaks can be particularly calamitous for electrical hardware, where the presence of small amounts of conducting fluid can cause electrical shorts and subsequent failure of the devices. Such leaks can also be very detrimental to the functioning of fiber optic equipment. The invasion of hydrogen bearing or hydrogen generating fluids into fiber optic equipment can cause darkening of the fibers and an eventual loss of the optical signal.

In the past, once detected, such leaks have been repaired by methods such as flowing across them with liquid sealants. While effective, the leak must first be discovered, and then the liquid sealant must be pumped through the leak. In the downhole environment, the time within which the leak is discovered and subsequently remedied can be quite substantial. Thus, the downhole tools and equipment are subjected to extended periods of contamination that can have detrimental effects on the operation of the tools and equipment.

There exists, therefore, a need for remedying a downhole leak with liquid sealant that does not require pumping the liquid sealant subsequent to discovery of the leak.

DETAILED DESCRIPTION OF PREFERRED EMBODIMENTS

Figure 1:
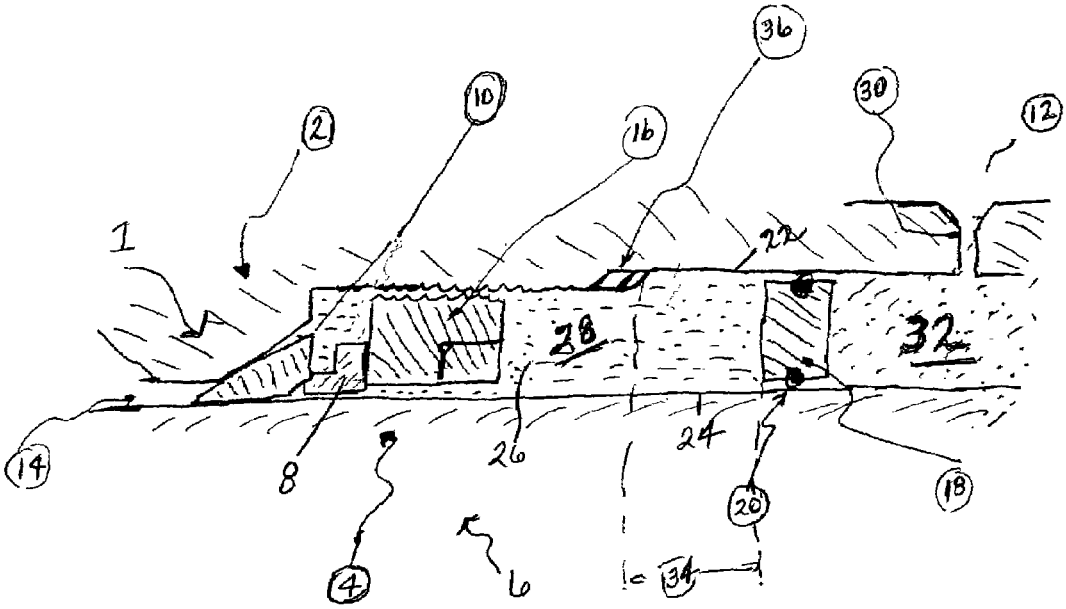
FIG. 1 provides a sketch of an embodiment of the present invention adapted to remedy leaks in a metal-metal seal.

The present invention provides a method of remedying a minute downhole leak using liquid sealant stored in a local reservoir. In the various described embodiments of the present invention, the liquid sealant is a pressure activated sealant similar to that carried by companies such as Seal-Tite International. The sealant carries monomers and polymers in suspension. Such sealants are traditionally pumped downhole when a leak develops in the downhole tools, in the downhole equipment, or in the tubing. When the sealants flow out of a leak with a relatively high surface area to leak ratio, the monomers and polymers "coagulate" in a cross-linking mechanism across the leak, and cause it to "heal."

The "healing" phenomenon requires a pressure differential above a certain threshold for it to be viable. The quantity of sealant required to perform the healing can be minimized to a very small quantity by increasing the monomer and polymer concentrations to a very high level. The quantity of sealant is also very small when the surface area to leak ratio is very high, as would be expected in the instance of a minute leak in a metal-metal seal.

It is important to note that the term "minute" as used herein, describes any leak that can be remedied by flowing sealant therethrough. In other words, a minute leak has a surface area to leak ratio that allows the particular sealant to coagulate across the leak to heal it. The term minute is both dependent upon the surface area to leak ratio and the sealant chosen for a particular application.

One embodiment of the method of the present invention is described with reference to FIG. 1, which provides a sketch of a metal-metal seal, indicated generally by the numeral 1, existing between a first body 2 and a second body 4. The first and second bodies 2, 4 can be any number of components within downhole tools or equipment having mating surfaces intended to be free from fluid leakage. For purposes of discussion, the metal-metal seal 1 will be described as existing within a downhole tool 6.

The metal-metal seal 1 of FIG. 1 is comprised of dual ferrules 8, 10 that are engaged to prevent the high pressure fluid 12 located outside the downhole tool 6 from invading a low pressure environment 14 existing inside the downhole tool 6. The ferrules 8, 10 are energized and held in place though the use of an energizing nut 16 that is installed with an appropriate locking tool (not shown). The energizing nut 16 is used to force the first ferrule 8 to wedge the second ferrule 10 between the first and second bodies 2, 4. Once wedged, the second ferrule 10 provides a metal-metal seal 1 between the bodies 2, 4. The metal-metal seal 1 is maintained by the energizing nut 16. As shown in the figure, the energizing nut 16 does not form a fluid barrier.

Within the second body 4, exists a piston 18. The piston 18 has an elastomeric seal (such as an o-ring) 20 that maintains a fluid seal with the inside surfaces 22, 24 of the first and second bodies 2, 4. The elastomeric seal 20 acts to prevent the high pressure fluid 12 located outside of the downhole tool 6 from invading the metal-metal seal 1. A cavity 26 is formed within the first and second bodies 2, 4 and is defined by the metal-metal seal 1, the inside surfaces 22, 24 of the first and second bodies 2, 4, and the elastomeric seal 20. The cavity 26 acts as a local reservoir for storing sealant. The energizing nut 16 is located within the cavity 26.

Prior to installing the piston 18, liquid sealant 28 is placed into the cavity 26. The base fluid selected for the liquid sealant 28 is generally selected such that the sealant 28 is not harmful to the internal equipment. For example, a dielectric fluid can be used as the base fluid in an electrical application. Similarly, the base fluid can be non-hydrogen generating or even a hydrogen scavenging fluid for use with optical cable. Again, the elastomeric seal 20 prevents the liquid sealant 28 from communicating with the high pressure fluid 12. Once the piston 18 has been installed, pressure testing is performed through a pressure port 30 housed within the first body 2.

To pressure test the metal-metal seal 1, a test fluid 32 such as hydraulic oil or water is pumped into the pressure port 30. The test fluid pressure is transmitted through the piston 18 to the liquid sealant 28. Accordingly, the liquid sealant 28 applies pressure on the metal-metal seal 1 to test the integrity of the seal.

In the event that minute leaks exist during testing, the liquid sealant 28 flows through the leak with a high pressure drop, causing it to seal. If a new leak develops during the lifetime of the metal-metal seal 1, the pressure of the external high pressure fluid 12 would act to drive the liquid sealant 28 through the leak to remedy it.

The travel area 34 of the piston 18 is designed to ensure that the piston 18 can exert adequate pressure on the liquid sealant 28 to enable flow through the metal-metal seal 1 to remedy the leak. The travel area 34 must accommodate the travel of the piston 18 both during the initial pressure test and upon the occurrence of additional minute leaks developed during the life of the metal-metal seal 1.

In the event a large leak develops (i.e., one that the liquid sealant 28 is unable to remedy), the embodiment shown in FIG. 1 provides a detection mechanism. The detection mechanism is comprised of a shoulder, edge, or other protruding element 36 located on one of the inside surfaces (in this case the upper surface) 22, 24 of the first or second bodies 2, 4 just beyond the intended travel area 34 of the piston 18. In the event of a large leak, the piston 18 will travel until its upper surface abuts the protruding element 36. At this point, the piston 18 bottoms out causing a loss of the seal provided by the elastomeric seal 20, and enabling detection of the leak. Once the large leak is detected, re-preparation of the metal-metal seal 1 can be initiated.

It should be noted that the dual ferrule metal-metal seal 1 described with reference to FIG. 1 is intended to be illustrative and not limiting of the scope of the present method. It should also be noted that the specific geometry of the first and second bodies 2, 4 is not limited to that shown in the illustration. Any geometry that would enable the formation of a cavity 28 between a piston 18 and a metal-metal seal 1 that is suitable for containing a liquid sealant falls within the purview of the invention.

Figure 2:
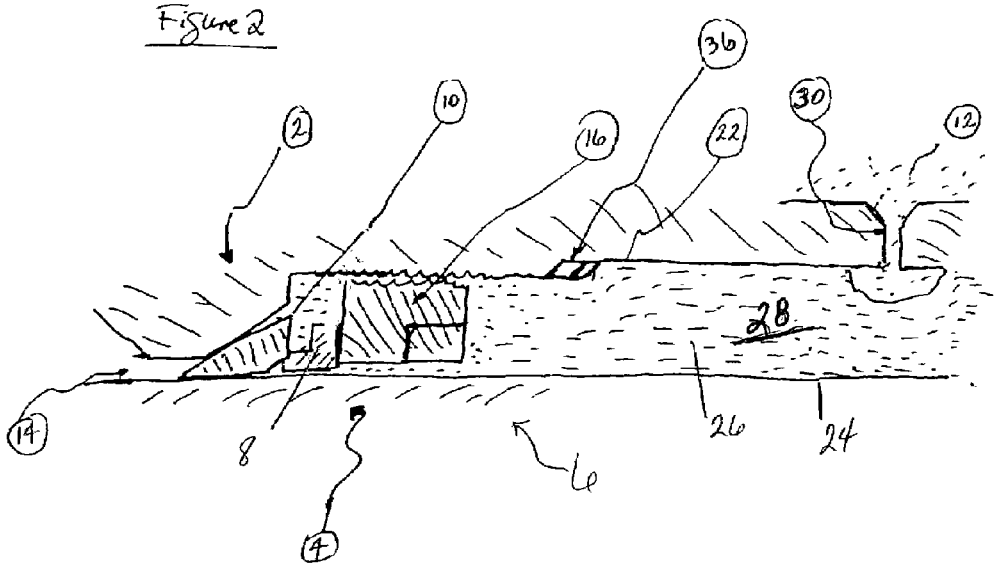
FIG. 2 provides a sketch of another embodiment of the present invention adapted to remedy leaks in a metal-metal seal.

Another embodiment of the method of the present invention is described with reference to FIG. 2, which provides a sketch of a metal-metal seal 1 between a first body 2 and a second body 4. As with FIG. 1, the illustrative metal-metal seal 1 is comprised of dual ferrules 8, 10 that are energized by an energizing nut 16. The metal-metal seal 1 prevents the high pressure fluid 12 located outside the downhole tool 6 from invading the low pressure environment 14 existing within the downhole tool 6. Once again, the energizing nut 16 does not form a fluid barrier.

In this embodiment, a high viscosity liquid sealant 28 is used as the initial pressure test fluid and is pumped into the pressure port 30. The high viscosity liquid sealant 28 gels in the cavity 26 and adheres to the cavity walls 22, 24. Thus, any minute leaks existing during the pressure test are remedied immediately.

Subsequent to the pressure test, the remaining liquid sealant 28 that has gelled in the cavity 26 and adhered to the cavity walls 22, 24 acts to remedy leaks that form during the life of the metal-metal seal 1. Upon development of such a leak, the external fluid 12 that is immiscible in the gelled liquid sealant 28, acts to energize the sealant 28 and drive the sealant 28 through the developed leak to remedy it.

Another embodiment of the method of the present invention is described with reference to FIGS. 3 and 4. This embodiment illustrates the use of a local reservoir of liquid sealant 28 in a sealing mechanism such as that described in U.S. patent application Ser. No. 10/024,410, entitled "Redundant Metal-Metal Seal", and incorporated herein by reference.

Figure 3:
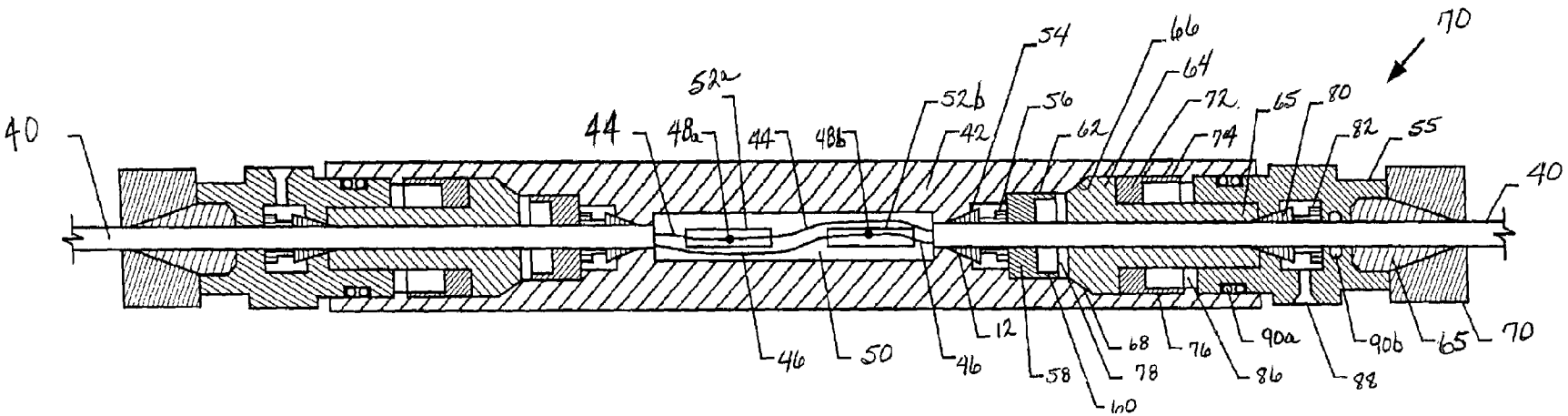
FIG. 3 provides a sketch of an embodiment of a downhole electric splice assembly having a redundant metal-metal seal assembly.

FIG. 3 provides a sketch of an embodiment of the downhole electric splice assembly having the redundant metal-metal seal assembly to which the incorporated patent application is directed. In FIG. 3, cables 40 are spliced together within a housing 42. Each of the cables 40 are carrying two communication lines 44, 46 from which spliced connections 48*a*, 48*b* are formed. The spliced connections 48*a*, 48*b* are located within an internal cavity 50 within the housing 42 and are each housed within protective casings 52*a*, 52*b*.

The primary metal-metal seal is formed by a pair of ferrules 54, 56. The primary seal is energized and held in place by action of a primary retainer 58. In the embodiment shown, the primary retainer 58 comprises securing dogs 60 and a threaded outer diameter 62. The securing dogs 60 correspond to mating dogs on an installation tool (not shown). The installation tool is used to apply torque to the primary retainer 58, which in turn imparts a swaging load on the ferrules 54, 56 and imparts contact stress between the ferrules 54, 56 and the cable 40 and between the ferrules 54, 56 and the housing 42. As such, a seal is formed by the ferrules 54, 56 between the housing 42 and the cable 40. The swaging load and contact stress, and thus the seal, is maintained by the threaded outer diameter 62 of the primary retainer 58.

The secondary metal-metal seal is formed by a seal element 64 having a conical section 66 that corresponds with a mating section 68 of the housing 42. The secondary metal-metal seal provides redundancy to prevent leakage between the housing 42 and the seal assembly 70. The conical section 66 is forced into sealing contact with the mating section 68 by action of a secondary retainer 72. Similar to the primary retainer 58, the secondary retainer 72 comprises securing dogs 74 and a threaded outer diameter 76. As with the primary retainer 58, an installation tool (not shown) is used to apply torque to the secondary retainer 76, which in turn imparts contact stress between the conical section 66 and the mating section 68 to form a seal therebetween. The contact stress of the shouldered contact is maintained by the threaded outer diameter 76 of the secondary retainer 72. It should be noted that the primary gap 78 that exists between the primary retainer 58 and the seal element 64 ensures that the process of energizing the secondary metal-metal seal does not affect the contact stresses on the primary seal between the housing 42 and the cable 40. It should further be noted that in one embodiment, the seal element 64 comprises one or more ferrules forced into sealing contact with the mating section 68 of the housing 42.

The tertiary metal-metal seal is formed by a pair of ferrules 80, 82 that engage the end 65 of the seal element 64. The tertiary metal-metal seal, energized by the end plug 84, provides redundancy to prevent leakage between the cable 40 and the seal assembly 70. As with the ferrules 54, 56 of the primary seal, in certain instances, the ferrules 80, 82 of the tertiary seal are coated with a soft metal to increase the local contact stresses with the cable 42. A secondary gap 86 exists between the secondary retainer 72 and the end plug 84 that prevents the energizing load from affecting the mating components on the secondary seal. Load transmitted to the end of the secondary retainer 72 is dissipated through the end plug 84 to the housing 42. The end plug 84 further comprises a pressure port 88 and one or more elastomeric seals 90*a*, 90*b* that enable pressure testing (as will be discussed below) of the seal assembly 70.

To isolate all the seals from axial loading, vibration and shock conveyed from the cables 40, an anchor 92 is energized against the cables 40 by action of the end nut 94. In one embodiment, the anchor 92 is a collet style anchor.

Figure 4:
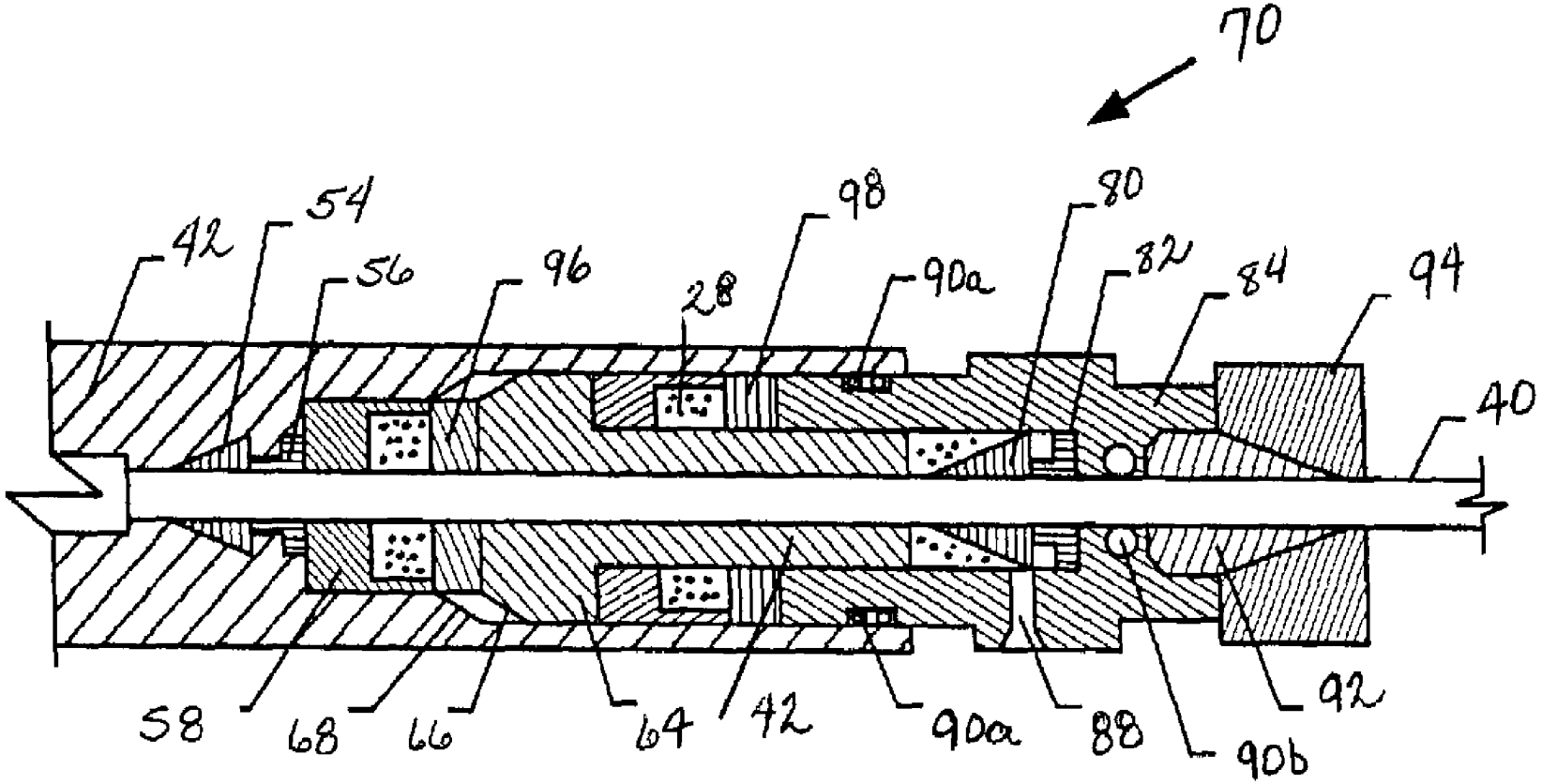
FIG. 4 provides a sketch of an embodiment of the present invention adapted to remedy leaks in an embodiment of the seal assembly of FIG. 3.

FIG. 4 provides an illustration of the configuration of the seal assembly 70 used to pressure test the primary seal. Testing of the primary seal requires insertion of spacers 96, 98 to prevent accidentally engaging the secondary and tertiary seals. In one embodiment, the spacers 96, 98 are constructed with a circumferential gap to enable installation and removal from the seal assembly 70. The first spacer 96 prevents the conical section 66 of the seal element 64 from contacting the mating section 68 of the housing 42 to form the secondary metal-metal seal. Likewise, the second spacer 98 prevents the ferrules 80, 82 from engaging the end 65 of the seal element 64 to form a seal. To test, fluid is pumped through the pressure port 88. The fluid is prevented from escaping the housing 42 opposite the primary seal by the one or more elastomeric seals 90*a*, 90*b*. After testing, the spacers 96, 98 are removed and the seal cavity is cleared of the test fluid. Subsequently, the secondary and tertiary seals are energized as described above, and the anchor 92 is installed and energized.

In an embodiment of the method of the present invention, the pressure testing of the secondary and tertiary seals is done by pumping the high viscosity liquid sealant 28 (described above) through the pressure port 88. The sealant 28 gels in the internal cavity of the housing 42 and adheres to the cavity walls. During pressure testing, the high viscosity liquid sealant 28 remedies leaks in the dual ferrule seal (primary seal) and the conical seal (secondary seal). After testing, upon development of a leak, external fluid that is immiscible in the gelled liquid sealant 28 acts to energize the sealant 28 remaining in the local reservoir (internal cavity) and drives the sealant 28 through the developed leak to remedy it.

Yet another embodiment of the method of the present invention is described with reference to FIG. 5. This embodiment illustrates the use of a local reservoir of liquid sealant 28 to remedy leaks through defects in welds. One example of such welds is described in U.S. patent application Ser. No. 09/970,353, entitled "Field Weldable Connections", and incorporated herein by reference.

Figure 5:
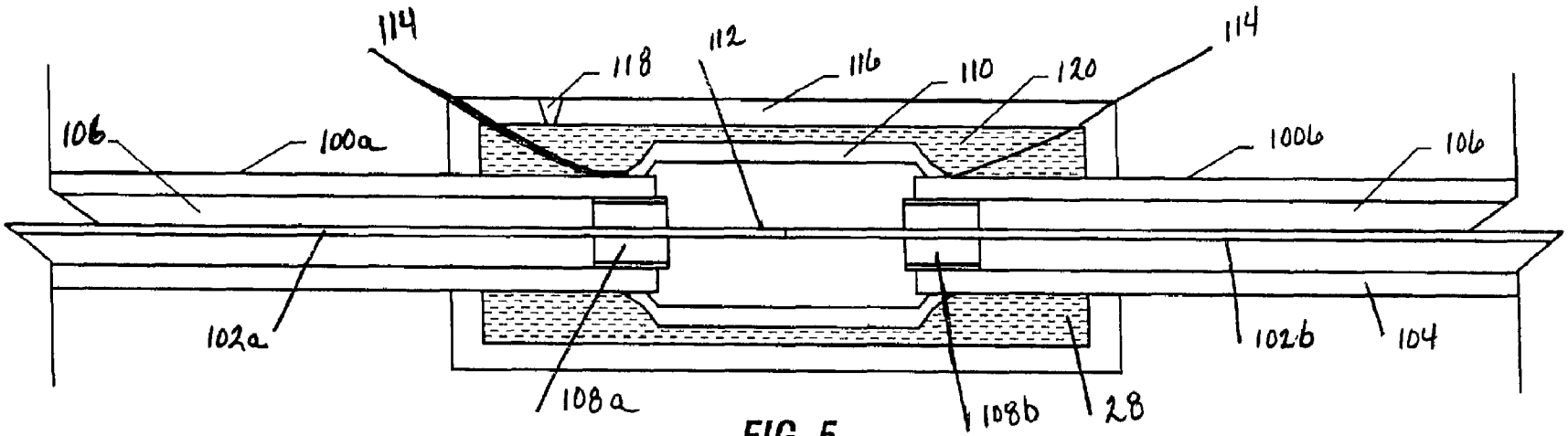
FIG. 5 provides a sketch of an embodiment of the present invention adapted to remedy leaks in a welded connection.

FIG. 5 provides a sketch of an exemplary embodiment of a welded connection to which the above incorporated patent application is directed. The welded connection provides a protective housing over a spliced cable. In this embodiment, the splice was achieved by first cutting the cable 100 (designated as 100*a* and 100*b*) so that the communication line 102 (designated as 102*a* and 102*b*), that extends therethrough, extends longitudinally beyond the outer housing 104 and the secondary housing 106. Afterwards, a portion of the secondary housing 106 is removed for insertion of thermal insulators 108*a*, 108*b*. The insulators 108*a*, 108*b* lie between the outer housing 104 and the communication lines 102*a*, 102*b*. The insulators 108*a*, 108*b* protect the communication lines 102*a*, 102*b* from the heat of the welding. Additionally, the insulators 108*a*, 108*b* prevent the secondary housing from melting and outgassing, which can result in poor weld quality.

Prior to splicing, a weld coupling 110 is slid over one of the cables 100*a*, 100*b*. The cleaved communication lines 102*a*, 102*b* are then spliced together by conventional techniques, such that the communication lines 102*a*, 102*b* are operatively connected at the splice 112. The weld coupling 110 is then slid to cover the ends of both cables 100*a*, 100*b* and the weld coupling 110 is secured in place by welds 114.

A pressure housing 116 fits over the weld coupling 110. The pressure housing 116 is slid over the same cable 100*a*, 100*b* as the weld coupling 110, but is slid prior to the sliding of the weld coupling 110. After splicing and after the weld coupling 110 is secured in place, the pressure housing 116 is attached to the cables 100*a*, 100*b* such that the weld coupling 110 is isolated from environmental conditions. For example the housing 116 may be attached by welding, ferrules, or elastomeric seals, among other means. A port 118, located in the pressure housing 116 enables pressure testing of the welded assembly.

In an embodiment of the method of the present invention, the pressure testing of the welded splice assembly is performed by pumping the high viscosity liquid sealant 28 through the port 118 and into the cavity 120 defined by the pressure housing 116, the cables 100 and the weld coupling 110. The liquid sealant 28 gels in the internal cavity 120 and adheres to the cavity walls. During pressure testing, the high viscosity liquid sealant 28 remedies leaks in the welded splice assembly. After testing, upon development of a leak, external fluid that is immiscible in the gelled liquid sealant 28 acts to energize the sealant 28 remaining in the local reservoir (cavity 120) and drives the sealant 28 through the developed leak to remedy it.

Still another embodiment of the method of the present invention is described with reference to FIG. 6. This embodiment illustrates the use of a local reservoir of liquid sealant to remedy leaks in a signal transfer line system. One example of such signal transfer line system is described in U.S. patent application Ser. No. 09/660,693, entitled "Pressurized System for Protecting Signal Transfer Capability at a Subsurface Location", and incorporated herein by reference.

Figure 6:
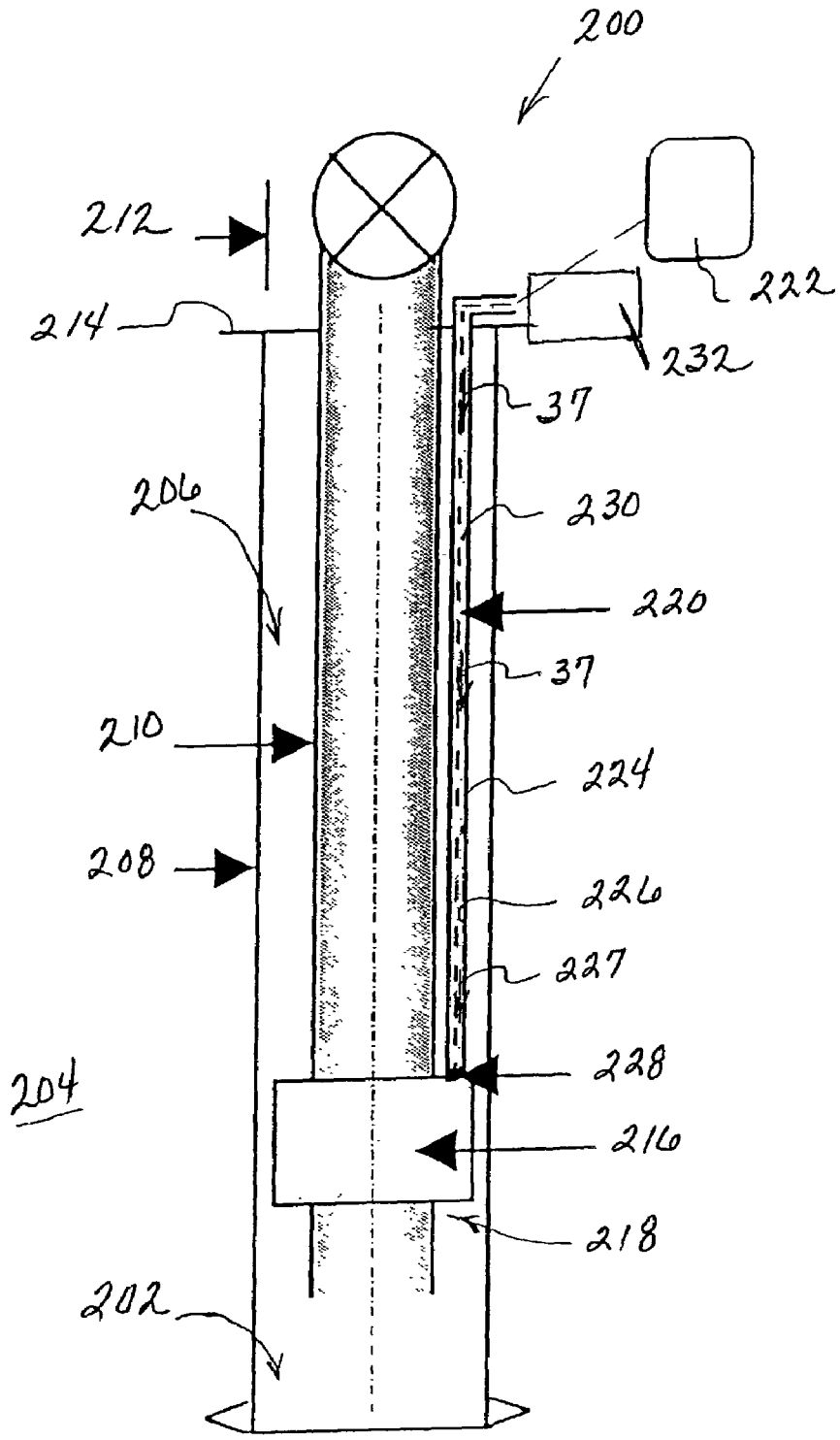
FIG. 6 provides a sketch of an embodiment of the present invention adapted to remedy leaks in a signal transfer line system.

FIG. 6 provides a sketch of an exemplary embodiment of the system to which the above incorporated patent application is directed. As shown, the system 200 is illustrated as being utilized in a well 202 within a geological formation 204 containing desirable production fluids, such as petroleum. In the application illustrated, a wellbore 206 is drilled and lined with a wellbore casing 208.

In many systems, the production fluid is produced through a tubing 210, e.g. production tubing, by, for example, a pump (not shown) or natural well pressure. The production fluid is forced upwardly to a wellhead 212 that may be positioned proximate the surface of the earth 214. Depending on the specific production location, the wellhead 212 may be land-based or sea-based on an offshore production platform. From wellhead 212, the production fluid is directed to any of a variety of collection points, as known to those of ordinary skill in the art.

A variety of downhole tools are used in conjunction with the production of a given wellbore fluid. In FIG. 6, a tool 216 is illustrated as disposed at a specific downhole location 218. Downhole location 218 is often at the center of very hostile conditions that may include high temperatures, high pressures (e.g., 15,000 PSI) and deleterious fluids. Accordingly, overall system 200 and tool 216 must be designed to operate under such conditions.

For example, tool 216 may constitute a pressure temperature gauge that outputs signals indicative of downhole conditions that are important to the production operation; tool 216 also may be a flow meter that outputs a signal indicative of flow conditions; and tool 216 may be a flow control valve that receives signals from surface 214 to control produced fluid flow. Many other types of tools 216 also may be utilized in such high temperature and high pressure conditions for either controlling the operation of or outputting data related to the operation of, for example, well 202.

The transmission of a signal to or from tool 216 is carried by a signal transmission line 220 that extends, for example, upward along tubing 210 from tool 216 to a controller or meter system 222 disposed proximate the earth's surface 214. Exemplary signal transmission lines 220 include electrical cable that may include one or more electric wires for carrying an electric signal or an optic fiber for carrying optical signals. Signal transmission line 220 also may comprise a mixture of signal carriers, such as a mixture of electric conductors and optical fibers.

The signal transmission line 220 is surrounded by a protective tube 224. Tube 224 also extends upwardly through wellbore 206 and includes an interior 226 through which signal transmission line 220 extends. A fluid communication path 227 also extends along interior 226 to permit the flow of fluid therethrough.

Typically, protective tube 224 is a rigid tube, such as a stainless steel tube, that protects signal transmission 220 from the subsurface environment. The size and cross-sectional configuration of the tube can vary according to application. However, an exemplary tube has a generally circular cross-section and an outside diameter of one quarter inch or greater. It should be noted that tube 224 may be made out of other rigid, semi-rigid or even flexible materials in a variety of cross-sectional configurations. Also, protective tube 224 may include or may be connected to a variety of bypasses that allow the tube to be routed through tools, such as packers, disposed above the tool actually communicating via signal transmission line 220.

Protective tube 224 is connected to tool 216 by a connector 228. Connector 228 is designed to prevent leakage of the high pressure wellbore fluids into protective tube 224 and/or tool 216, where such fluids can detrimentally affect transmission of signals along signal transmission line 220. However, most connectors are susceptible to deterioration and eventual leakage.

To prevent the inflow of wellbore fluids, even in the event of leakage at connector 228, fluid communication path 227 and connector 228 are filled with a fluid 230. An exemplary fluid 230 is a liquid, e.g., a dielectric liquid used with electric lines to help avoid disruption of the transmission of electric signals along transmission line 220.

Fluid 230 is pressurized by, for example, a pump 232 that may be a standard low pressure pump coupled to a fluid supply tank. Pump 232 may be located proximate the earth's surface 214, as illustrated, but it also can be placed in a variety of other locations where it is able to maintain fluid 230 under a pressure greater than the pressure external to connector 228 and protective tube 224. Due to its propensity to leak, it is desirable to at least maintain the pressure of fluid within connector 228 higher than the external pressure at that downhole location. However, if pump 232 is located at surface 214, the internal pressure at any given location within protective tube 224 and connector 228 typically is maintained at a higher level than the outside pressure at that location. Alternatively, the pressure in tube 224 may be provided by a high density fluid disposed within the interior of the tube.

In the event connector 228 or even tube 224 begins to leak, the higher internal pressure causes fluid 230 to flow outwardly into wellbore 206, rather than allowing wellbore fluids to flow inwardly into connector 228 and/or tube 224. Furthermore, if a leak occurs, pump 232 preferably continues to supply fluid 230 to connector 228 via protective tube 224, thereby maintaining the outflow of fluid and the protection of signal transmission line 220. This allows the continued operation of tool 216 where otherwise the operation would have been impaired.

In an embodiment of the present invention, the supplied fluid 230 is liquid sealant. The liquid sealant has a base fluid that is non-damaging such as the use of dielectric fluid for electrical cable. The liquid sealant is of low enough viscosity to enable pumping through the protective tube 224.

In this embodiment, the protective tube 224 is pre-filled with the liquid sealant. The liquid sealant gels and adheres to the walls of the protective tube 224. Additionally, a reservoir of the sealant is located in the pump system. As leaks develop, liquid sealant is pumped through the protective tube 224 forcing the liquid sealant located within to flow through the leak to remedy it. The remaining sealant can be flowed through later developing leaks. The reservoir has to be replenished after exhaustion, but the pumping system does not have to continuously pump the fluid 230.

Alternatively, the protective tube 224 can be pre-filled with another fluid such as a dielectric fluid rather than sealant. Upon detection of a leak, sealant is pumped through the protective tube 224. As such, the pump 232 first acts to displace the pre-filled fluid down to the leak with sealant, and then remedies the leak by flowing the sealant through it.

The invention being thus described, it will be obvious that the same may be varied in many ways. Such variations are not to be regarded as a departure from the spirit and scope of the invention, and all such are intended to be included within the scope of the following non-limiting claims:

What is claimed is:

1. A method of remedying minute seal leaks in downhole equipment, comprising:

connecting a pair of downhole components in sealing engagement via a dual ferrule connection; and providing pressure activated liquid sealant stored in a local reservoir proximate the dual ferrule connection to remedy a potential leak at the dual ferrule connection.

2. The method of claim 1, further comprising:

applying test pressure to the downhole equipment to force the liquid sealant to flow through any seal leaks.

3. The method of claim 1, further comprising:

applying external pressure to the downhole equipment to force the liquid sealant to flow through any seal leaks.

4. The method of claim 1, further comprising:

providing a pressure responsive piston within the reservoir in communication with the liquid sealant, wherein the piston, upon application of external pressure, forces the liquid sealant to flow through any seal leak.

5. The method of claim 1, wherein the liquid sealant comprises monomers and polymers in suspension and adapted to flow through a leak and coagulate to remedy the leak.

6. The method of claim 1, wherein the liquid sealant is a high viscosity sealant that gels in the local reservoir and adheres to the walls of the local reservoir.

7. The self-healing metal-metal seal of claim 6, wherein the metal-metal seal is a dual ferrule seal.

8. The self-healing metal-metal seal of claim 6, wherein the liquid sealant comprises monomers and polymers in suspension that remedy leaks upon flowing therethrough.

9. The self-healing metal-metal seal of claim 6, wherein the liquid sealant is a high viscosity sealant that gels in the local reservoir and adheres to the walls of the local reservoir.

10. The self-healing metal-metal seal of claim 6, wherein the liquid sealant further comprises a dielectric base fluid.

11. The self-healing metal-metal seal of claim 6, wherein the liquid sealant further comprises a non-hydrogen generating base fluid.

12. The self-healing metal-metal seal of claim 6, wherein the liquid sealant is activated by high pressure test fluid.

13. The self-healing metal-metal seal of claim 6, wherein the liquid sealant is activated by external fluid pressure.

14. A self-healing metal-metal seal within a downhole tool, comprising:

a first body, a second body, a metal-metal seal between the first and second body, a local reservoir defined by the first body, the second body, and the metal-metal seal, the local reservoir moving downhole with the first body, the second body and the metal-metal seal during deployment of the downhole tool, and pressure activated liquid sealant stored within the local reservoir, wherein the local reservoir is further defined by a pressure sensitive piston sealed within the reservoir, the pressure sensitive piston acting against the pressure activated liquid sealant to move the pressure activated liquid sealant into a leak that may develop in the metal-metal seal.

15. The self-healing metal-metal seal of claim 14, wherein the piston is driven by external pressure to force the liquid sealant through any leaks to remedy the leak.

16. The self-healing metal-metal seal of claim 14, wherein the local reservoir further comprises a detection mechanism.

17. The self-healing metal-metal seal of claim 16, wherein the detection mechanism comprises means to release the seal of the piston.

18. A method of remedying a leak in downhole metal-metal seal, comprising:

providing a local reservoir in communication with the metal-metal seal, filling the local reservoir with pressure activated liquid sealant, forcing the liquid sealant to flow through a leak to remedy the leak, and maintaining the pressure activated liquid sealant under pressure to remedy an additional leak at a later period in time.

19. The method of claim 18, further comprising:

providing a pressure sensitive piston within the local reservoir, wherein the pressure sensitive piston is responsive to external fluid pressure to force the liquid sealant to flow through any leaks.

20. A self-healing sealing assembly for a downhole connection, comprising:

a primary metal-metal seal, at least one independently energized redundant metal-metal seal, a housing defining an interior that prevents the energization of the at least one independently energized redundant metal-metal seal from affecting the contact stresses on the primary metal-metal seal, a high viscosity liquid sealant located within the housing and adapted to flow through leaks in the primary metal-metal seal and the at least one independently energized redundant metal-metal seal, and a detection mechanism for detecting a relatively large leak.

21. The self-healing seal assembly of claim 20, wherein the liquid sealant gels within the housing and adheres to the housing walls.

22. The self-healing seal assembly of claim 20, wherein the liquid sealant is activated during pressure testing.

23. The self-healing seal assembly of claim 20, wherein the liquid sealant is activated by external fluid upon development of a seal leak.

24. A downhole sealing assembly, comprising:

a housing having an internal cavity, a primary metal-metal seal having at least a pair of ferrules energized by a member and adapted to prevent fluid from entering the internal cavity, one or more independently energized metal-metal seals adapted to prevent fluid from reaching the primary metal-metal seal and to prevent affecting the contact stresses of the primary metal-metal seal upon energization, and a high viscosity liquid sealant contained in the internal cavity and adapted to flow through any developed leaks.

25. A method of protectively sealing downhole equipment, comprising:

providing a housing having an internal cavity, providing a primary metal-metal seal adapted to prevent fluid from flowing therethrough, providing one or more independently energized redundant metal-metal seals adapted to prevent fluid from contacting the primary metal-metal seal, preventing the energization of the one or more independently energized redundant metal-metal seals from affecting the contact stresses of the primary metal-metal seal, providing a high viscosity liquid sealant within the internal cavity that is adapted to remedy leaks by flowing therethrough.

* * * * *